United States Patent [19]

Robinson

[11] Patent Number: 4,666,098

[45] Date of Patent: May 19, 1987

[54] CREEL AND METHOD OF OPERATION THEREOF

[75] Inventor: Anthony J. Robinson, Cheshire, United Kingdom

[73] Assignee: Rieter Scragg Limited, Cheshire, United Kingdom

[21] Appl. No.: 817,142

[22] Filed: Jan. 8, 1986

Related U.S. Application Data

[63] Continuation-in-part of Ser. No. 584,635, Feb. 29, 1984, abandoned.

[30] Foreign Application Priority Data

Mar. 19, 1983 [GB] United Kingdom ..... 8307665

[51] Int. Cl.[4] ..... B65H 49/10; B65H 49/14

[52] U.S. Cl. ..... 242/131

[58] Field of Search ..... 242/131, 131.1, 130; 57/90; 28/190, 193; 66/125 R; 139/450

[56] References Cited

U.S. PATENT DOCUMENTS

| | | | |
|---|---|---|---|
| 2,490,874 | 12/1949 | Keight et al. | 242/131 |
| 3,115,315 | 12/1963 | Dunlap, Jr. et al. | 242/131 |
| 3,169,248 | 2/1965 | Cont | 242/131 |
| 3,674,223 | 7/1972 | Philip | 242/131 |
| 3,690,586 | 9/1972 | Bock | 242/131 |
| 3,716,203 | 2/1973 | Beasley | 242/131 |
| 3,915,406 | 10/1975 | Rolli et al. | 242/131 |
| 3,930,385 | 1/1976 | Greczin | 242/131 |
| 4,023,747 | 5/1977 | Champagne | 242/130 |
| 4,261,532 | 4/1981 | Davis et al. | 242/131 |

FOREIGN PATENT DOCUMENTS

| | | | |
|---|---|---|---|
| 2246231 | 4/1973 | Fed. Rep. of Germany | 242/131 |
| 153800 | 2/1982 | Fed. Rep. of Germany | 242/131 |
| 760616 | 11/1956 | United Kingdom | 242/131 |
| 1351121 | 4/1974 | United Kingdom | 242/131 |

*Primary Examiner*—Stanley N. Gilreath

*Attorney, Agent, or Firm*—Oblon, Fisher, Spivak, McClelland & Maier

[57] ABSTRACT

A creel is provided for a textile machine, the creel including a frame mounted in a C-shaped support structure so as to be pivotal about its vertical central axis. The frame defines four spaces on each of three levels. In each space are pivotally mounted a pair of mutually spaced package support arms which are movable between two operative positions offset towards each side of the space so that a larger diameter reserve package can only be accomodated on one package arm when the in-use package on the other package arm of that pair has been used sufficiently to reduce its diameter significantly. This enables large packages to be used in a creel of lower height than would otherwise be required, to reduce package handling problems. The new package can be put into the creel when the in-use package is of sufficiently small diameter and since both packages are mounted in operative positions transfer of yarn unwinding can be made to the new package on expiry of the in-use package without the attendance of the machine operator.

17 Claims, 2 Drawing Figures

CREEL AND METHOD OF OPERATION THEREOF

BACKGROUND OF THE INVENTION

1. Field of the Invention

This invention is a continuation-in-part application of U.S. application Ser. No. 584,635 now abandoned and relates to a creel for textile yarn processing machines, and a method of operating such a creel.

2. Description of the Prior Art

Textile yarn processing machines require a supply of unprocessed yarn, and from an economic standpoint it is preferable if the supply is continuous. Many types of such machines are of the multi-station variety and each station is supplied with yarn withdrawn from one of a large number of packages mounted in a creel structure standing near to the machine. Adjacent each package from which yarn is being withdrawn at any given moment, a reserve package is mounted, and the two packages have their yarn ends joined so that yarn automatic withdrawl is transferred to the reserve package when the first package is exhausted. The exhausted package is then replaced by a new full package which then becomes the reserve package. In this way the supply of unprocessed yarn to each station of the yarn processing machine is continuously maintained.

However, as yarn processing speeds have increased it has become more difficult and tiring for the machine operator to ensure that exhausted packages are replaced by full packages in good time to maintain the continuity of the processing, particularly in the case of a machine having a large number of yarn processing stations and when using large and therefore heavy packages. For example a modern false twist crimping machine has approximately 200 yarn processing stations and the supply packages can each be up to 34 kg in weight. Coupled with this increase in the weight of packages is their physical size which can be up to 445 mm in diameter and 250 mm in length.

It has always been an objective to reduce the overall size of textile machines. Typically false twist crimping machines are about 18,000 mm in length, having some 216 processing stations disposed 12 on each machine side to a bay. Consequently 12 full packages in use are required per side per bay and therefore 12 full reserve packages adjacent thereto.

Conventionally creels have been of the 'gate' type which comprise a rectangular 'space-frame' structure of metal tubes. On the upright ones of such tubes, package mounting arms are pivotally mounted, so that the packages are normally disposed within the space frame but may be pivoted so as to extend outside the space frame for loading and unloading purposes. To supply such a machine, 24 packages are required within the length of a bay on each side of the machine whilst only four full large size packages can be housed at one level. Consequently the creel is formed to be six packages high, with the uppermost packages being at a height of up to 3 meters. It is therefore very difficult for packages of 34 kg weight to be placed on the uppermost packaging mounting arms.

It has therefore been proposed to provide creels of the 'rotary' type. Such creels are also of a metal tube 'space-frame' construction but in this case the package mounting arms are normally disposed to extend radially towards the centre of each bay-sized creel section, being pivotally mounted on the vertical tubes disposed on the circumference of the creel section. The packaging mounting arms are again pivotal to extend outside the creel section for loading and unloading. With such an arrangement it is possible to have six packages on any one level so that the creel section can be only four packages high. However, even in such an arrangement the uppermost packages are at a height of about 2 meters, and with the large and heavy packages currently used this still presents a problem for the machine operator. Furthermore in order that the packages farthest from the aisles at the outside of the creel can be loaded and unloaded, the creel section itself is mounted so as to be rotatable about a central shaft pivot structure. It is required that processing of the yarn is maintained during loading of new packages and unloading of empty package tubes, and in order that the yarn path lengths are not altered during such rotation of the creel, the yarns are led adjacent the central pivot shaft of the creel. This leads to a complicated arrangement of yarn guides in order to prevent entanglement of the yarns. From U.S. Pat. No. 4,261,532 it is known to provide a creel in which a rectangular frame has mounted at each corner thereof a support for two yarn packages. The packages are each mounted on a spindle having its axis directed towards a respective yarn guide located on or adjacent the central axis of the frame so that yarn can be readily withdrawn from any one package to a central yarn guide. Each support is pivotal about its mounting at the corner of the frame so as to ensure correct alignment of the package carrying spindles supported thereon with a central yarn guide. However the dimensions of the frame place a constraint on the size of package which can be accommodated in the creel, and if a support is pivoted from its single position in which the spindles mounted thereon are correctly aligned with the central yarn guides, withdrawal of a yarn from a package on such spindle will be adversely affected if not prevented.

SUMMARY OF THE INVENTION

It is an object of the present invention to provide a creel, and a method of operating same, in which the uppermost packages are at a more readily accessible height than with the creels used heretofore, and in which relatively large packages can be accommodated.

The invention provides a creel adapted to receive yarn packages comprising a frame having an axis and defining a plurality of packages receiving spaces, a pair of mutually spaced package support arms disposed in each package receiving space and pivotal about an axis adjacent to and parallel with the frame axis therewithin between two operating positions in which the arms extend substantially radially outwardly from said frame axis and the median plane between said arms is displaced from and to opposed sides of the median plane of said space, and in such a creel, a method of withdrawing yarn comprising placing a package of a predetermined large first diameter on one arm of each pair of arms only when an in-use package supported by the other arm of said pair of arms has a second diameter less than said predetermined large first diameter, after having pivoted the pair of support arms from a first to a second of the two operating positions.

By means of the invention a greater number of packages can be received on any one level of the creel, thereby allowing the creel to be of lesser height than was possible heretofore and yet still support the same number of packages per bay length of a textile machine.

Preferably said frame is mounted so as to be rotatable about a substantially vertical central axis, and said pairs of arms are then mounted adjacent said central axis so as to extend substantially radially therefrom. Said frame may comprise a support member for each pair of arms and be disposed to support the respective pair of arms throughout the range of pivotal movement thereof between the two operating positions.

The frame may be mounted within a supporting structure which extends around said frame and provides pivot mountings for said frame on said central axis at the lower and upper ends of said frame. By means of this construction the central axis of the frame may be free from any central shaft pivot structure as required on rotary creels used heretofore, thereby enabling the yarns to be led from the packages in the creel to guides located on or very close to the central axis.

Various other objects, features and attendant advantages of the present invention will be more fully appreciated as the same becomes better understood from the following detailed description when considered in connection with the accompanying drawings in which like reference characters designate like or corresponding parts throughout several views and wherein:

DESCRIPTION OF THE PREFERRED EMBODIMENTS

Figure 1:
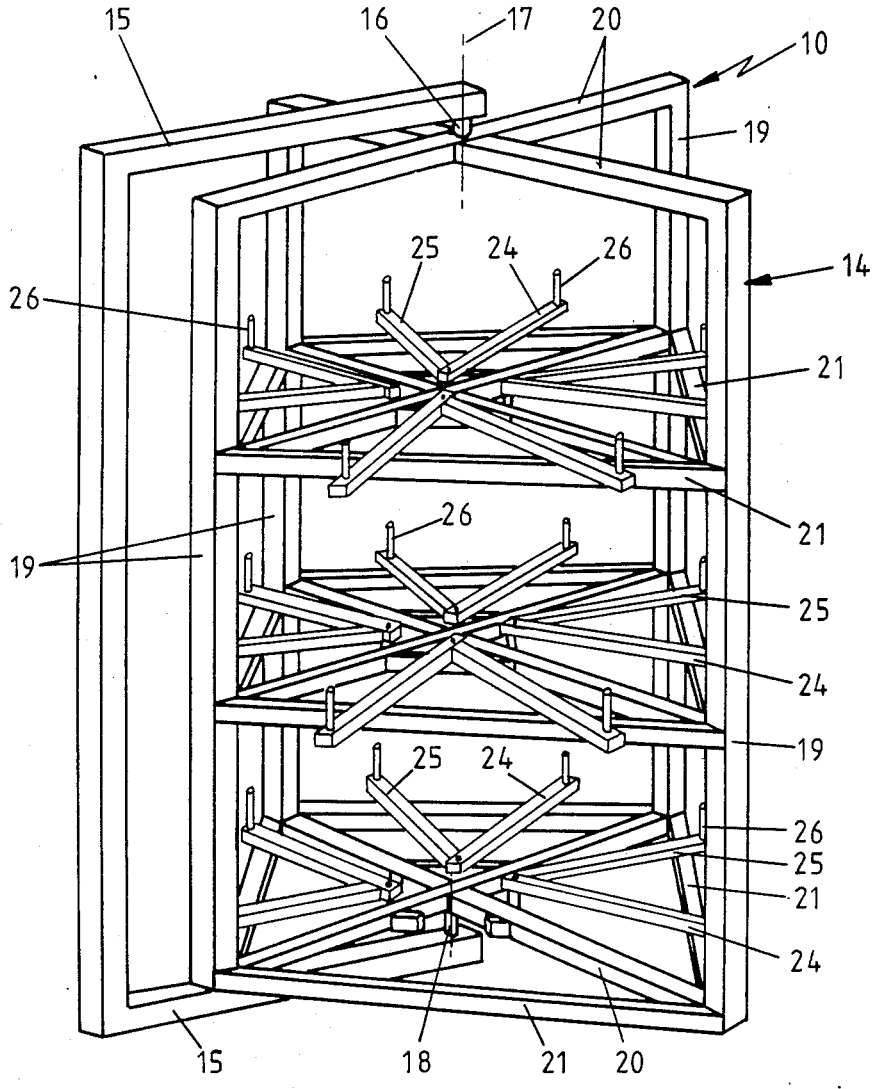
FIG. 1 is a perspective view with the package mounting arms removed for clarity.

Referring now to the Figures there is shown a creel 10 for the servicing of a single bay of a textile machine (not shown). In practice a creel unit may have up to nine such creels adjacent each other to service one side of the textile machine, the machine having 216 processing stations on its two sides with nine bays of twelve stations each per side of machine. Each creel 10 is adapted for the mounting thereon of twelve in-use packages 11 and twelve reserve packages 12 to supply the twelve stations per bay, each reserve package 12 being connected by transfer tail 13 to a respective processing station when the in-use package 11 is exhausted.

The creel 10 comprises a frame 14 which is pivotally mounted within a generally C-shaped support structure 15. In practice the nine support structures 15 are adjacent each other to form the complete creel unit. The support structure 15 comprises a lower bearing 18 and an upper bearing 16 in which the frame 14 is mounted for rotation about a vertical central axis 17.

The frame 14 comprises four vertical members 19 secured to each other by radial members 20 and by peripheral members 21. The structure provides three levels for the mounting of packages 11, 12 and four package receiving spaces 22 per level. At each level and in each package receiving space 22 there extends between each adjacent pair of radial members 20 a pivot carrying member 23, each carrying a pivot 28. Pivotally mounted on each pivot 28 are a pair of package support arms 24, 25 which are secured to each other with a fixed angle between them, for example by welding. Similarly the frame 14 may be constructed by welding together vertical members 19, radial members 20 peripheral members 21 and pivot carrying members 23.

At the free end of each package support arm 24, 25 is an upstanding package mounting post 26 onto which a package mounting arm 27 may be pivotally retain (such being omitted from FIG. 1 for clarity). The aforementioned fixed angle between a coupled pair of package support arms 24, 25 is such that, only when an 'in-use' package 11 mounted on the package mounting arm 27 mounted on one of the pair of support arms 24, 25 is of less diameter than the predetermined first diameter for which the creel is designed, can a new 'reserve' package 12 be mounted on the package mounting arm 27 mounted on the other of the pair of support arms 24, 25. In this manner more pairs of packages 11, 12 can be accommodated in a given space, or conversely the same number of pairs of packages 11, 12 can be accommodated in a reduced space, on one creel level, in the creel of the present invention than was possible heretofore. Consequently even when using the large reserve packages of 445 mm diameter, four pairs of packages 11, 12 can be accommodated on one level of the creel of the present invention within the space required for one bay of the textile machine. The present creel need therefore be only three levels high, thereby reducing the height to which the heavy packages 12 have to be lifted and obviating the need for steps or the like for the operator to use, as was required with creels having four or more levels.

Figure 2:
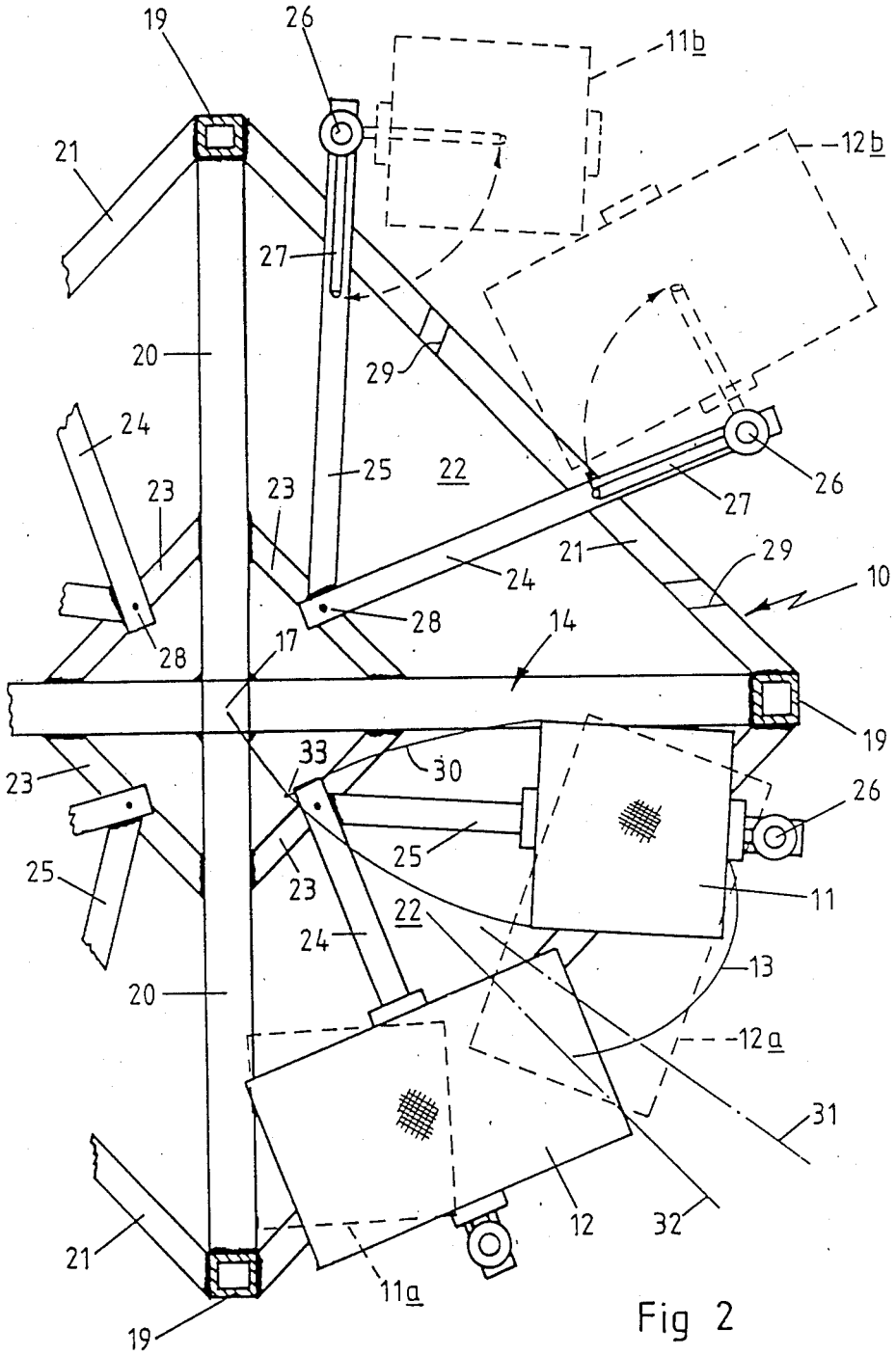
FIG. 2 is a sectional plan view of the creel of FIG. 1.

The package support arms 24, 25 with packages 11, 12 mounted thereon as shown in full lines in FIG. 2 are supported by members 21 in aa first operating position. In this position the median plane 31 between the arms 24, 25 is offset relative to the median plane 32 of the package receiving space 22 to one side thereof. When an 'in-use' package 11 has been used sufficiently such that its diameter has reduced to a second diameter substantially less than the predetermined first diameter, a new reserve package 12 is placed on the adjacent package support arm 24 or 25 and the transfer tail 13 joined the two packages 11, 12. The second diameter for the 'in-use' package 11 at which this operation is performed may be for example of the order of 260 mm, i.e. approximately 60% of that of a new package. The weight of such a partially used package will be of the order of 9.5 to 10 kg. A package of such size would generally be sufficient to ensure a supply of yarn for a 12 hour night shift in a yarn texturizing mill, sot that new packages need only be loaded during a day-time shift.

When an 'in-use' package 11 mounted on support arm 25 is empty, the 'reserve' package 12 becomes the 'in-use' package. When this second 'in-use' package has been used sufficiently such that its diameter has reduced to a second diameter of about 60% or less of the first diameter of a new package, the arms 24, 25 are rotated about pivot 28. The 'in-use' package then assumes the second operating position shown in dashed lines in FIG. 2 at 11*a* and a new 'reserve' package 12*a* may be placed on package support arm 25, the new reserve package 12*a* also being shown in dashed lines in FIG. 2. In this second operating position the median plane between the arms 24, 25 is offset relative to, by the same amount as but to the opposite side of, the median plane 32 of the package receiving space 22, compared with the first operating position.

This procedure is repeated as each 'in-use' package 11 becomes of the second, sufficiently small, diameter, the package support arms 24, 25 being moved from one to the other of the two operating positions shown in FIG. 2 with each loading of a new reserve package 12. To facilitate this operation detents 29 or other stop means may be provided in peripheral members 21 to retain the support arms 24, 25 in the appropriate positions.

For the purpose of loading new reserve packages 12 and the removal of empty package bobbins, the mounting arms 27 are rotatable on posts 26 so as to extend outwardly of the creel frame 14, as shown in dashed lines 11*b*, 12*b* in FIG. 2. In order that loading onto and unloading from the package mounting arms 27 disposed at the machine side of the creel can be achieved, the frame 14 can be rotated about axis 17 within the C-shaped support structure 15. Since the frame 14 is supported on in bearings 16, 18 there is no frame structure on the axis 17 within the frame 14 itself. As a consequence of this construction the yarns 30 from each of the 'in-use' packages 11 can be led to a respective yarn guide 33 located adjacent the axis 17 of the creel 10 in each package receiving space 22, then along the axis 17 and thereafter to the input feed means of the textile machine, so that rotation of frame 14 does not cause entanglement of the yarns 30. Each pair of arms 24, 25 can be moved from one operating position to the other operating position independently of the other pairs of arms so that new packages can be loaded into the creel as necessary as individual in-use packages become sufficiently used.

Obviously numerous modifications and variations of the present invention are possible in the light of the above teachings. It is therefore to be understood that within the scope of the appended claims, the invention may be practised otherwise than as specifically described herein.

What is claimed as new and desired to be secured by Letters Patent of the United States is:

1. A creel adapted to receive yarn packages, comprising: a frame having an axis and which defines a plurality of package receiving spaces therein and a median plane of each space; for each space, a respective yarn guide located adjacent said frame axis; a pair of mutually spaced package support arms disposed in each space and defining a median plane between said arms; pivot means providing a respective pivot axis for each of said pair of arms, each said pivot axis being disposed adjacent to and substantially parallel with said frame axis; arm position defining means defining two operating positions for each pair of arms whereby each pair of arms is pivotal about the respective pivot axis between said two operating positions and whereby in each of said operating positions said arms are located within said space and extend substantially radially outwardly from said frame axis and said median plane between said arms is displaced from and to opposed sides of said median plane of said space.

2. A creel according to claim 1 wherein said frame axis is disposed substantially centrally of said frame.

3. A creel according to claim 1 wherein said median plane between said arms move between positions spaced equally from but on opposed sides of said median plane of said package receiving space when said arms move between said operating positions.

4. A creel according to claim 1 wherein the arms of each said pair of arms mutually connected so as to be movable together between said operating positions.

5. A creel according to claim 1 wherein said frame comprises a respective support for each pair of arms disposed to support said pair of arms at a location spaced from said pivot means throughout the range of movement thereof between said operating positions.

6. A creel according to claim 5 wherein said support comprises an elongate member and said arm position defining means comprise detents in said elongate member.

7. A creel according to claim 1 wherein each pair of arms is mounted in said frame so as to be pivotal between the respective said operating positions independently of the other pairs of arms.

8. A creel according to claim 1 wherein each support arm has a free end spaced from said pivot axis and a package mounting post upstanding from said free end.

9. A creel according to claim 8 further comprising a package mounting arm pivotally mounted on said package mounting post.

10. A creel according to claim 2, further comprising a C-shaped support, and means for mounting said frame in said C-shaped support for rotation about said central axis.

11. A creel according to claim 10 wherein said frame mounting means comprises lower and upper ends and said C-shaped support extends around said frame and has pivot mountings for said frame located on said axis at said lower and upper ends of said frame.

12. A creel according to claim 1 wherein said frame defines three levels each having four package receiving spaces defined thereon.

13. A method of withdrawing yarn from packages mounted in a creel adapted to receive yarn packages, said creel comprising: a frame having an axis and which defines a plurality of package receiving spaces therein and a median plane of each space; for each space, a respective yarn guide located adjacent said frame axis; a pair of mutually spaced package support arms disposed in each space and defining a median plane between said arms; pivot means providing a respective pivot axis for each of said pair of arms, each said pivot axis being disposed adjacent to and substantially parallel with said frame axis; arm position defining means defining two operating positions for each pair of arms whereby each pair of arms is pivotal about the respective pivot axis between said two operating positions and whereby in each of said operating positions said arms are located within said space and extend substantially radially outward from said frame axis and said median plane between said arms is displaced from and to opposed sides of said median plane of said space; said method comprising the steps of:

(a) mounting a first yarn package having a first diameter on one support arm of a pair of support arms and locating said pair of support arms in a first one of said operating positions, (b) withdrawing yarn from said first yarn package towards said frame axis, (c) pivoting, when said first yarn package has reduced in diameter to a second diameter less than said first diameter, said pair of support arms to the other of said operating positions, and (d) mounting a second yarn package having said first diameter on the other support arm of said pair of support arms and joining free ends of the yarns on said first and second packages together whereby when said first package becomes empty yarn is withdrawn from said second package towards said frame axis.

14. A method according to claim 13 comprising the subsequent step of (e) pivoting, when said yarn package has reduced in diameter to said second diameter, said support arms to said first operating position, and then repeating steps (a) to (d).

15. A method according to claim 13 wherein said second diameter substantially 60% of said first diameter.

16. A method according to claim 13 comprising pivoting a package mounting arm relative to a respective support arm out of said space, mounting a yarn package on said package mounting arm and then pivoting said package mounting arm relative to said support arm back into said space.

17. A method according to claim 12 wherein said frame axis is disposed substantially centrally of said frame, comprising rotating said frame about said frame axis in order to mount new yarn packages in spaces on opposed sides of said creel.

* * * * *